United States Patent [19]

Moore

[11] 4,220,337

[45] Sep. 2, 1980

[54] SWIMMING POOL BALL GAME AND A TILTED BACKSTOP FOR USE IN THE GAME

[76] Inventor: Robert E. Moore, 8637 Maryford Dr., San Diego, Calif. 92119

[21] Appl. No.: 4,068

[22] Filed: Jan. 17, 1979

[51] Int. Cl.[2] ..... A63B 63/00; A63B 71/00

[52] U.S. Cl. ..... 273/395; 273/407; 273/411

[58] Field of Search ..... 273/103, 1.5 R, 1 R, 273/95 R, 95 H; 272/1 B

[56] References Cited

U.S. PATENT DOCUMENTS

| | | | |
|---|---|---|---|
| 2,161,463 | 6/1939 | Frost | 273/103 X |
| 2,207,864 | 7/1940 | Hoelte | 273/95 R X |
| 2,614,839 | 10/1952 | Forsythe | 273/95 R X |
| 2,781,194 | 2/1957 | Sistrunk | 273/95 H X |
| 2,812,946 | 11/1957 | Hughes | 273/95 H |
| 2,818,254 | 12/1957 | Donn | 273/1.5 R |
| 2,944,816 | 7/1960 | Dixon | 273/103 X |
| 3,743,286 | 7/1973 | Weinhagen | 272/1 B X |

FOREIGN PATENT DOCUMENTS

| | | | |
|---|---|---|---|
| 234082 | 6/1961 | Australia | 273/1 R |
| 1385322 | 11/1964 | France | 273/95 R |

*Primary Examiner*—Paul E. Shapiro

*Attorney, Agent, or Firm*—Brown & Martin

[57] ABSTRACT

A ball game to be played in a swimming pool and a tilted backstop for use in the ball game. The backstop, includes a rigid broad board; and a supporting apparatus for supporting the board in a position that is tilted from the vertical at an angle in a range of ten degrees to twenty degrees when the supporting apparatus is placed upon a horizontal surface. The supporting apparatus includes a pair of rods extending horizontally from the bottom of the board in the direction that the top of the board is tilted forward. The forward ends of the rods are bent downward for hooking over the edge of a curb for preventing the board from being thrust backward when the forward broad surface of the board is struck. The backstop is positioned on a horizontal surface against a curb at the edge of a swimming pool so that the forward ends of the rods hook over the edge of the curb. A first person positioned in the swimming pool throws a ball to strike the forward board surface of the board so as to rebound from the board either directly toward the pool or onto the horizontal surface at the top of the curb and thence toward the pool. A second person positioned in the pool tries to catch the ball. Scoring of the game is determined by whether or not the ball is caught and how far it rebounds from the board if it isn't caught.

10 Claims, 2 Drawing Figures

SWIMMING POOL BALL GAME AND A TILTED BACKSTOP FOR USE IN THE GAME

BACKGROUND OF THE INVENTION

The present invention generally pertains to games and game apparatus and is particularly directed to a ball game to be played in a swimming pool and a tilted backstop for use in the game.

It has been popular for a long time to play ball games in swimming pools. Such games have included bouncing a ball off of the edge of the pool and trying to catch it, with the scoring of the game being based upon whether or not the ball is caught. However, the edge of a swimming pool provides a relatively small vertical target and thereby somewhat limits the complexity of ball games that can be played by bouncing a ball off of the edge of the pool.

Also, it has been popular for a long time for boys to play games wherein they bounce a ball off of a wall or a backstop and score the game based upon whether or not the ball is caught and where the ball lands when it isn't caught. Boys often play imaginary "baseball" games in this manner, with a single, double, triple, or home run being scored depending upon how far from the wall or backstop the ball lands when it is not caught. Of course when the ball is caught, an out is scored.

Backstops are used for playing such a game when a usable wall is not conveniently available. There are many prior art backstops which may be used for such a game. Typical backstops are described in U.S. Pat. Nos. 2,944,816 to Dixon; 2,986,398 to Oliver; 3,001,795 to Johnson, Jr.; and 3,013,801 to Kirkconnell, Jr. The backstop described in the Dixon patent is particularly useful in that the top of the broad surface of the backstop may be tilted either forward or backward with respect to the direction from which the ball is thrown. The backstop includes supporting apparatus extending rearward from the broad surface of the backstop, and also includes stakes which are driven into the ground for preventing the backstop from being thrust backward when the forward broad surface of the backstop is struck with a ball.

However, such a backstop is not useful for playing ball games in a swimming pool because the ground surfaces around a swimming pool are generally hard, whereby it is difficult to anchor such a backstop so that it would not be thrust backward each time it is struck with a ball.

SUMMARY OF THE INVENTION

The present invention provides a novel backstop and a method of playing novel ballgame in a swimming pool by using the novel backstop. The backstop of the present invention includes a broad panel for rebounding a thrown ball; supporting apparatus for supporting the panel for rebounding the ball, wherein the panel is supported in a position that is tilted from the vertical when the supporting apparatus is placed upon a horizontal surface; and wherein the backstop is characterized by the supporting apparatus including a plurality of rods extending horizontally from the bottom of the panel in the direction that the top of the panel is tilted forward when the supporting apparatus is placed on a horizontal surface, wherein the forward ends of the rods are bent so that they extend downward when the apparatus is so placed for hooking over the edge of a curb for preventing the backstop from being thrust backward when the forward broad surface of the panel is struck with a ball.

The method of playing the novel ball game of the present invention includes positioning the backstop of the present invention on a horizontal surface against a curb at the edge of a swimming pool, so that the rods of the supporting apparatus extend horizontally from the bottom of the panel in the direction toward the pool and the forward ends of the rods which are bent extend downward and are hooked over the edge of the curb for preventing the backstop from being thrust backward when the forward broad surface of the panel is struck with a ball; and throwing a ball to strike the forward broad surface of the panel so as to rebound from the panel either directly toward the pool or onto the horizontal surface at the top of the curb and thence toward the pool.

The positioning of the backstop of the present invention against a curb at the edge of a swimming pool provides a combination which enables a thrown ball to be rebounded toward the pool in either of two different characteristic modes of flight. If the ball is thrown to strike the lower portion of the broad surface of the panel it will also rebound off of the horizontal surface at the top of the curb and fly upward toward the far end of the pool. On the other hand, if the ball is thrown to strike sufficiently high enough on the broad surface of the panel as to clear the curb as it rebounds toward the pool, its direction of flight will be slightly downward, whereby it generally will not rebound as far as a ball rebounding off of both the panel and the curb before landing in the pool. Thus, an extra dimension is added to the game. This is especially so when two persons are playing the game, and one tries to catch balls thrown by the other. The thrower tries to throw the ball to so strike the backstop that the ball will not rebound to where the other person is positioned. And the other person positons oneself in accordance with an estimation as to how high up on the backstop the thrown ball will strike. This added dimension makes the game of the present invention more difficult and strategically more interesting than the prior art game wherein a ball is merely thrown at and rebounds from a wall or a backstop.

It is preferable that the angle of tilt of the panel from the vertical be in a range of from ten degrees to twenty degrees in order to provide optimum flight characteristics of the rebounded ball as pertain to both distance and height in relation to the edge of the swimming pool.

Additional features of the present invention are discussed with reference to the description of the preferred embodiment.

DESCRIPTION OF THE PREFERRED EMBODIMENT

Figure 1:
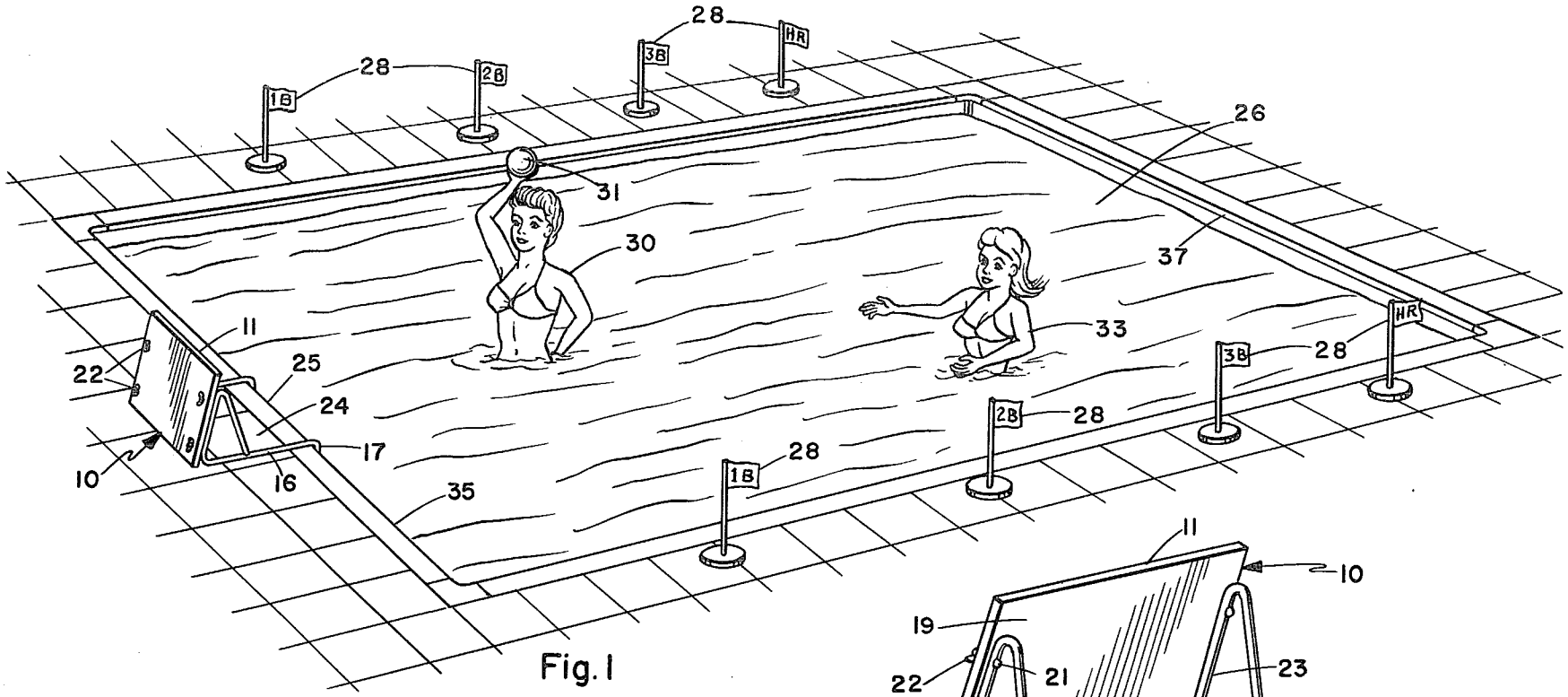
FIG. 1 is a perspective view illustrating the playing of the game of the present invention.
Figure 2:
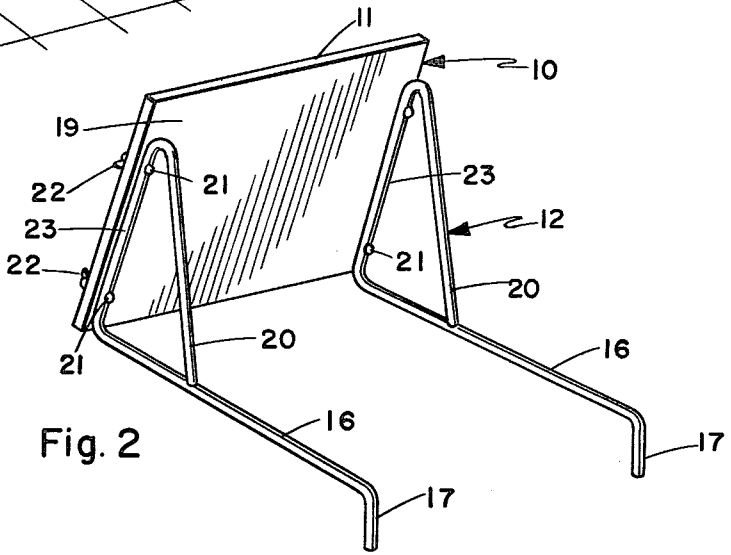
FIG. 2 is a perspective view illustrating the backstop of the present invention.

Referring to the Drawing, a preferred embodiment of the backstop 10 according to the present invention includes a broad panel 11 for rebounding a thrown ball; and supporting apparatus 12 for supporting the panel 10 for rebounding the ball.

The panel 11 is supported in a position that is tilted from the vertical by approximately fifteen degrees when the supporting apparatus is placed upon a horizontal surface.

The supporting apparatus 12 includes a pair of rods 16 which extend horizontally from the bottom of the panel 11 in the direction that the top of the panel is tilted forward when the supporting apparatus 12 is placed on a horizontal surface. The forward ends 17 of the rods 16 are bent so that they extend downward when the apparatus is so placed for hooking over the edge of a curb for preventing the backstop 10 from being thrust backward when the forward broad surface 19 of the panel 11 is struck with a ball. The other ends 20 of the rods 16 are bent upward and then over to engage the "horizontal" portions of the rods 16. The upward extending portions 23 of the rods 16 are attached to the panel 11 by bolts 21 and wing nuts 22.

Preferably, the panel 11 is a rigid board. However, the panel could be constructed of a flexible material that is held taut, such as a net attached to a framework by springs, as shown in the aforementioned patent to Dixon.

To play the ballgame of the present invention, the backstop 10 is positioned on a horizontal surface 24 against a curb 25 at the edge of a swimming pool 26.

Scoring indicators 28 are positioned on the deck 29 at the edge of the pool 26 at selected instances from the backstop 10 and generally forward of the backstop. The scoring indicators 28 are flags bearing the legends "1B", "2B", "3B" and "HR", signifying base hits of different magnitudes in a baseball game.

The panel 11 is supported in a position in which the top of the panel 11 is tilted forward from the vertical toward the pool 26 at an angle of fifteen degrees when the supporting apparatus 12 is positioned on the horizontal surface 24 of the deck 29 and the top of the curb 25. The pair of rods 16 extend horizontally from the bottom of the panel 11 in the direction toward the pool 26, and the forward ends 17 of the rods 16 are hooked over the edge of the curb 25 for preventing the backstop 10 from being thrust backward when the forward broad surface 19 of the panel 11 is struck with a ball.

One of the game participants 30 then throws a ball 31 to strike the forward broad surface 19 of the panel 11 so as to cause the ball 31 to rebound from the panel 11 either directly towards the pool 26 or onto the horizontal surface 24 at the top of the curb 25 and thence toward the pool 26.

The other participant 33 then tries to catch balls 31 that rebound from the panel 11.

The game is scored based upon whether the rebounding ball 31 is caught and where the ball lands in relation to the scoring indicators 28 when it is not caught. The game is scored the same as a baseball game. If the ball 31 is caught, an out is scored. If the ball rebounds beyond the boundary of the pool, an out is scored. If the ball lands in the pool between the "1B" indicator and the near end 35 of the pool 26, an out is scored. A single is scored when a rebounded ball is not caught and lands in the pool between the "1B" and "2B" indicators. A double is scored when a rebounded ball is not caught and lands in the pool between the "2B" and "3B" indicators. A triple is scored when a rebounded ball is not caught and lands in the pool between the "3B" and "HR" indicators. A home run is scored when a rebounded ball is not caught and lands in the pool between the "HR" indicators and the far end 37 of the pool 26.

The game of the present invention can be played in accordance with many different scoring rules. The scoring rules described above for a baseball game are merely exemplary. Also the game also can be played by only one participant, or by more than two participants, if so desired.

I claim:

1. A backstop, comprising a broad panel for rebounding a thrown ball;

supporting apparatus for supporting the panel for rebounding said ball, wherein the panel is supported in a position that is tilted from the vertical when the supporting apparatus is placed upon a horizontal surface;

characterized by the supporting apparatus including a plurality of rods extending horizontally from the bottom of the panel in the direction that the top of the panel is tilted forward when the supporting apparatus is placed on a horizontal surface, wherein the forward ends of the rods are bent so that they extend downward when the apparatus is so placed for hooking over the edge of a curb for preventing the backstop from being thrust backward when the forward broad surface of the panel is struck with a ball.

2. A backstop according to claim 1, wherein the angle of tilt from the vertical is in a range of from ten degrees to twenty degrees.

3. A backstop according to claim 2, wherein the panel is a rigid board.

4. A backstop according to claim 1, wherein the panel is a rigid board.

5. A method of playing a ball game, comprising the steps of positioning a backstop on a horizontal surface against a curb at the edge of a swimming pool, wherein the backstop comprises a broad panel for rebounding a thrown ball, and a supporting apparatus for supporting the panel for rebounding said ball, wherein the panel is supported in a position in which the top of the panel is tilted forward from the vertical toward said pool when the supporting apparatus is positioned on said horizontal surface, and wherein the supporting apparatus includes a plurality of rods extending horizontally from the bottom of the panel in the direction toward said pool when the supporting apparatus is positioned on said horizontal surface, wherein the forward ends of the rods are bent so that they extend downward and are hooked over the edge of said curb for preventing the backstop from being thrust backward when the forward broad surface of the panel is struck with a ball; and throwing a ball to strike the broad surface of the panel so as to rebound from the panel either directly toward the pool or onto the horizontal surface at the top of the curb and thence toward the pool.

6. A ball game according to claim 5, wherein the positioning step comprises positioning the backstop so that the top of the panel is tilted forward toward the pool at an angle from the vertical in a range of from ten degrees to twenty degrees.

7. A ball game according to claim 6, wherein the positioning step comprises so positioning a said backstop in which the panel consists of a rigid board.

8. A ball game according to claim 7, further comprising the steps of positioning scoring indicators at selected distances from the backstop and generally forward of the backstop;

trying to catch balls that rebound from the panel; and scoring the game based upon whether the rebounding ball is caught and where the ball lands in relation to the scoring indicators when it is not caught.

9. A ball game according to claim 6, further comprising the steps of positioning scoring indicators at selected distances from the backstop and generally forward of the backstop;

trying to catch balls that rebound from the panel; and scoring the game based upon whether the rebounding ball is caught and where the ball lands in relation to the scoring indicators when it is not caught.

10. A ball game according to claim 5, further comprising the steps of positioning scoring indicators at selected distances from the backstop and generally forward of the backstop;

trying to catch balls that rebound from the panel; and scoring the game based upon whether the rebounding ball is caught and where the ball lands in relation to the scoring indicators when it is not caught.

* * * * *